United States Patent [19]

Wittkopf

[11] Patent Number: 4,615,295

[45] Date of Patent: Oct. 7, 1986

[54] DOCTOR BLADE APPARATUS FOR COATING APPARATUS

[75] Inventor: Eugene W. Wittkopf, Suamico, Wis.

[73] Assignee: Magna-Graphics Corporation, Oconto Falls, Wis.

[21] Appl. No.: 721,782

[22] Filed: Apr. 10, 1985

[51] Int. Cl.[4] ..... B05C 1/08

[52] U.S. Cl. ..... 118/261; 118/212; 118/249

[58] Field of Search ..... 118/212, 261, 249

[56] References Cited

U.S. PATENT DOCUMENTS 2,157,874 5/1939 Webb ..... 118/261 X

*Primary Examiner*—John P. McIntosh

*Attorney, Agent, or Firm*—Andrus, Sceales, Starke & Sawall

[57] ABSTRACT

A coater includes a gravuer roll rotatably mounted in a fountain of coating material. A doctor blade engages the roll and doctors material from the surface. A curved predoctor deflector opens upstream of the material and has an inclined upper edge at about the level of the material to form a wedge-shaped gap forcing material into the roll. The deflector bottom is spaced from the fountain bottom to define a return path. A curved deflector at the doctor blade collects doctored material from the doctor blade and returns it to the return path. The predoctor generates a reverse material flow in the fountain creating a pressure at the return path to create a smooth circulation of coating material and essentially constant level in the said container.

12 Claims, 2 Drawing Figures

DOCTOR BLADE APPARATUS FOR COATING APPARATUS

BACKGROUND OF THE INVENTION

The present invention relates to a doctor blade apparatus for coating apparatus and particularly to a doctor blade apparatus establishing improved filling of a coating roll and stablizing the flow of liquid in the supply.

In the application of a ink coating to a member, rotary coating applicators are widely used. Coating is used herein to broadly define any liquid transfer from a supply. In a practical system, a gravure or analox cylinder or roll is rotatably mounted within the upper surface of the coating material to be transfered to the web. The surface of the roll is formed with minute recesses or cells to carry the coating material. The coating is accurately applied to the cylinder by mounting of a doctor blade to the discharge side of the bath. The roll dips into the material with pressure filling of the cells and the doctor blade removes excess material from the surface of the cylinder such that a precise and uniform quantity of the material is applied into the cells. The coated surface in then moved onto the moving web, directly or through an offset cylinder for subsequent transfer to the web, in accordance with known and recognized roller applicators.

In such apparatus, the high speed rotation of the cylinder in the bath tends to establish a flow of the material within the bath. The material tends to flow to the downstream side of the cylinder, with creation of a static pressure. The liquid material rises in the downstream side and tends to circulate about the ends of the cylinder to the upstream side with a disturbance in pressure for the filling the cells. Further, undesirable agitation and foaming of the material within the bath is often created. As the speed of rotation increases, the art has taught the use of special packing rolls for filling of the cells.

SUMMARY OF THE PRESENT INVENTION

Generally, in accordance with the present invention, the supply container is formed with an improved cell filling means including deflector means located in the supply and particularly in the downstream portion of the bath to establish a smooth continuous circulation of the liquid from adjacent the cell filling means and the doctor blade assembly back through the lower portion of the bath to establish and maintain an essentially constant level of the liquid throughout the bath. The deflector means includes a first curved deflector mounted adjacent to the downstream portion and spaced upstream from the doctor blade assembly. The curved deflector functions as a predoctor to limit the volume of the ink supply with the high speed roll and tends to smoothly direct and establish a flow of the liquid from along the upper surface portion of the bath downwardly to the lower portion, with the return flow moving back to the opposite end of the bath. The predoctor functions to also create a pressurized filling of the cells with the liquid. A second flow deflector is coupled to and located immediately adjacent to the doctor blade and serves to further direct the flow of the liquid from immediately adjacent to the cylinder surface downwardly and with a reverse flow into the gap between the first deflector and the bottom of the container. The rotating cylinder tends to create a relatively larger velocity in the upper portion of the bath with respect to a reverse velocity in the lower portion of the bath. The first deflector tends to divert the liquid being carried by the roll. The return flow in conjunction with the curved deflector appears to create a nozzle and venturi effect at the lower end of the first deflector means. This assists in the creation of the reduced pressure adjacent the first deflector and improves the flow of material. The result is a significant improvement in a smooth and undisturbed circulation of the liquid, with a minimum tendancy for the liquid to increase in level adjacent the discharge side of the cylinder. This also minimized the tendency for the liquid to flow laterally to the opposite ends of the roll.

The result of the present invention is therefore a relatively uniform undisturbed supply level which significantly contributes to application of a uniform and high quality filling of the roll and the resulting effective high quality transfer of the liquid on the web.

DESCRIPTION OF THE DRAWINGS

The drawings furnished herewith generally illustrate the best mode presently contemplated for the invention and are described hereinafter.

In the drawings.

DESCRIPTION OF THE ILLUSTRATED EMBODIMENT

Figure 1:
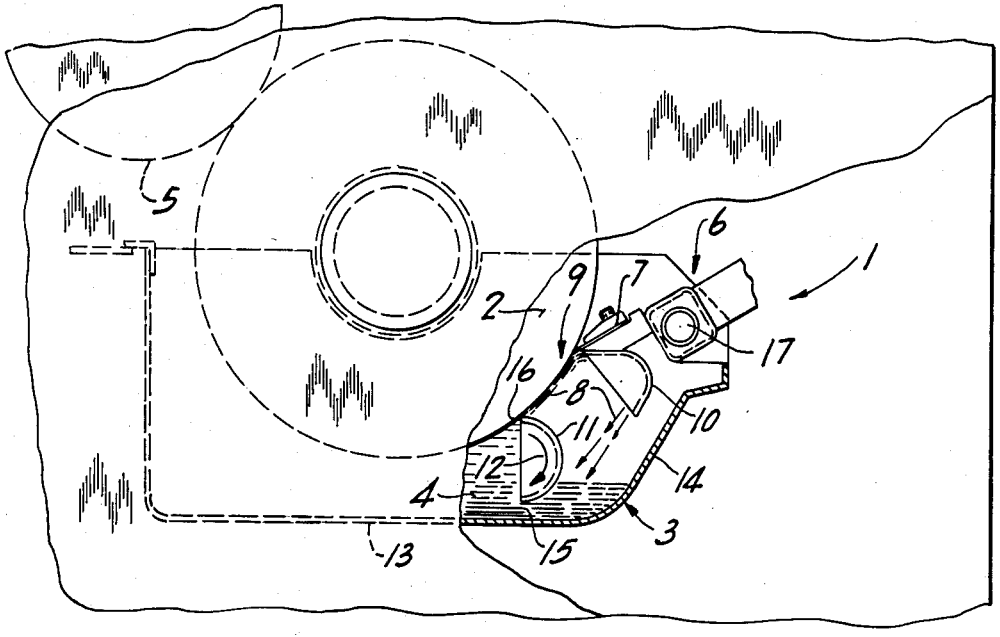
FIG. 1 is a side elevational view of a gravure roll coating apparatus, with parts broken away and sectioned to illustrate a predoctor assembly and a doctor blade assembly.

Referring to the drawing and particularly to FIG. 1, a gravure rotary coater 1 is illustrated for applying of a coating to one surface of a web, a sheet or any other substrate, not shown, as it had passed through the coater. A gravure cylinder or roll 2 is rotatably mounted with the lower portion thereof passing through a fountain 3 containing the ink or other coating material 4. The gravure roll 2 in accordance with conventional construction is formed with a pattern of adjacent, minute recesses, not shown, within which the coating material 4 is carried. After the material is applied to the roll, it can be transferred directly from the gravure roll to the substrate or though one or more additional transfer rolls. A transfer roll 5 is shown rotatably mounted above the gravure roll 2. The ink 4 is picked up by roll 2 transferred from roll 2 to the roll 5. The substrate, not shown, may for example pass between rolls 2 and 5, between the roll 5 and a further roll, not shown, pass directly over the gravure roll or the like for transfer of the coating to the substrate. It is important however to apply the material to fully fill the recesses without excess coating material being carried on the roll surface in order to effect an appropriate uniform and high quality transfer from the gravuer roll. A doctor blade assembly or unit 6 is mounted to the discharge side of the fountain 3 and includes a doctor blade 7 located with respect to the roll 2 to remove any excess coating, as at 8. The rotating movement of the roll 2 through the fountain generates forces in and on the coating material 4 within the fountain and the material tends to flow in the direction of the rotation. The forces on the material thus tend to move the material forwardly in the fountain. The forces within the coating material also tend to cause the material to flow laterally toward the ends of the doctor blade assembly 6 and roll 2. Such movement in the past has created significant difficulty with respect to maintaining a proper supply and transfer of the coating to the cylinder. There has also been a certain amount of agitation of the bath and a substantial variation in the level of the bath creating an inefficient transfer of the coating material to the surface of the roll 2. The coating material tends to rise around the end of the roll 2 and move upwardly along the end faces of the roll 2.

The present invention is particularly directed to the construction of the fountain 4 and particularly to the doctor blade assembly 6 in combination with a special predoctor unit 9 which functions as a pressurized filling means and a bath level and stabilizing apparatus. The coating apparatus may otherwise be of any suitable or desired construction and no further description thereof is given other than is necessary to clearly and fully describe the illustrated embodiment of the present invention.

Figure 2:
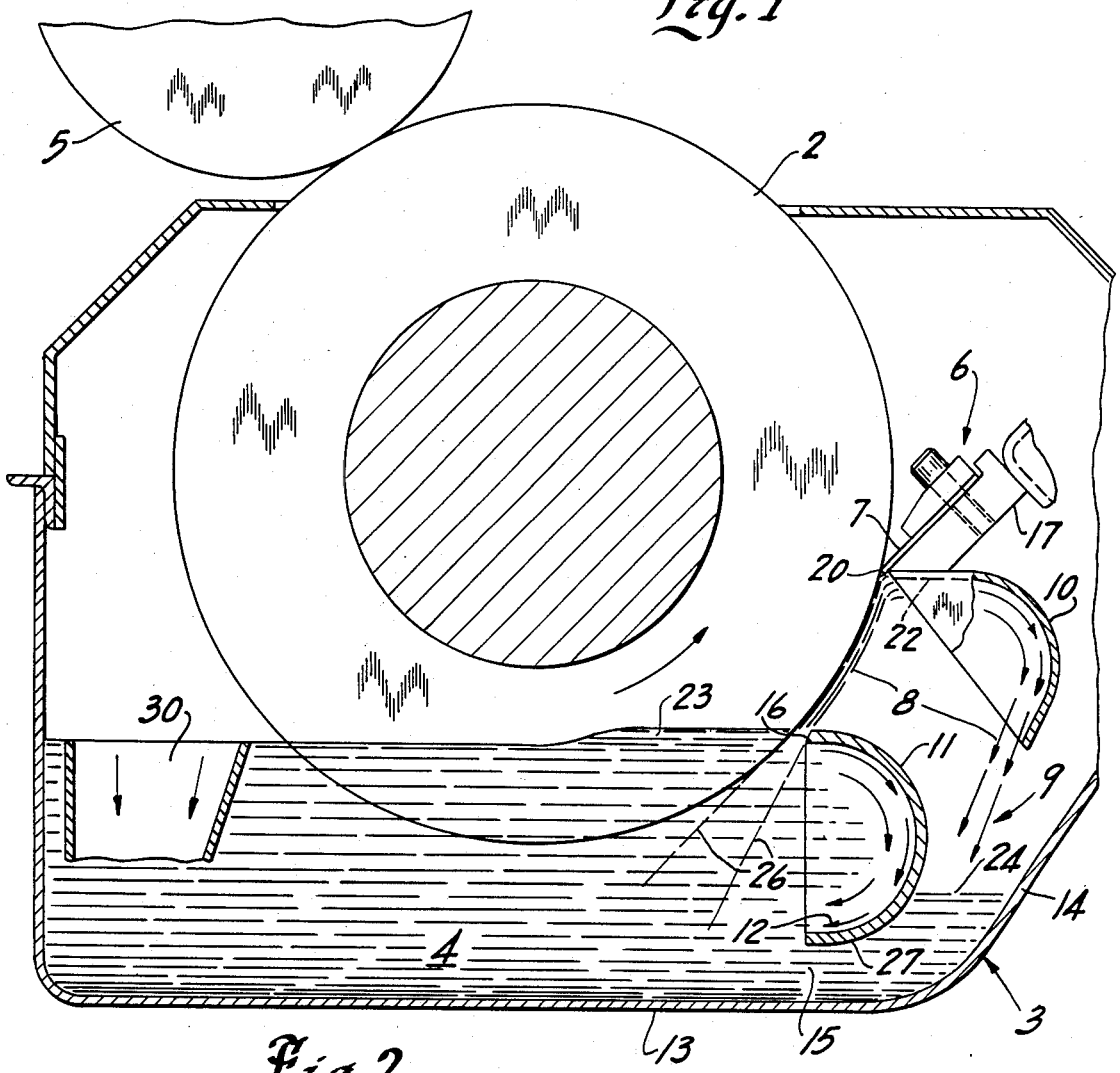
FIG. 2 is an enlarged view more clearly illustrating the action of the doctor blade assembly in the invention.

Referring particularly to FIGS. 1 and 2, the doctor blade 6 includes a flow deflector 10 and the predoctor unit 9 includes a flow deflector 11. The deflectors 10 and 11 are specially constructed and arranged to conjointly operate to establish a continuous and smooth flow of the doctored coating material 8 from unit 6 and from the upper surface of the bath from unit 9, as at 12. The doctored material flows downwardly and reversely into the trailing portion of the bath with smooth, laminar type flow as a result of the deflectors 10 and 11. The flow characteristic is such as to effectively balance the tendency of the rotating cylinder to cause the material to flow and build up in the leading portion of the coating bath. The deflector plates are generally simple curved members secured to the fountain. The deflector 10 of the assembly 6 is located above the level of the bath 4 and extends downwardly and rearwardly toward the pre-doctor unit 9. The deflector 11 of the pre-doctor unit 9 is located within the bath 4 and curves downwardly and rearwardly. The deflector 11 terminates in spaced relation to the bottom wall 13 of the fountain pan 14. The upper end edge 16 of the deflector 11 is spaced at the upper operating level of the bath 4 and functions as a predoctor which establishes an excessive coating of material on the roll 2 to insure filling of the gravure roll 2. The deflector 10 located immediately adjacent the doctor blade 7 deflects the removed material 8 into the bath and to gap 15 between the deflector 11 and the bottom wall 13 of the pan 14. The interaction of the return flow creates a pressure distribution tending to establish a smooth flow characteristic. Thus, the rapid moving liquid 12 which is forced downwardly and through the predoctor deflector 11 creates a pressure in the gap 15 and tends to create a venturi-type action with a significant improvement in the smooth flow of the doctored material 8 into the bath and in such a manner as to maintain an essentially constant liquid level. The high velocity flow 12 creates a negative pressure at the lower edge of the deflector 11 which creates a suction force on the liquid to the outside of deflector 11.

More particularly, the fountain pan 14 is a suitable open top container having flat end walls and inclined front and back walls connected to a flat bottom wall 13. In a practical structure, support arms, not shown, may be secured to the underside of the fountain with suitable hydraulic powered means provided to support the fountain in relation to the gravure cylinder or roll 2. The doctor blade assembly 6 is mounted to the downstream side of the fountain pan 14 and projects inwardly over the edge of the fountain to locate the doctor blade 7 in operative engagement with the cylinder. The doctor blade assembly, in accordance with preferred practice, is releasably mounted to the frame structure to permit mounting to either side of the fountain. Thus, depending upon the particular method of imprinting, the rotation of the gravure roll 2 may be reversed, with a reverse positioning of the doctor blade assembly and fountain.

More particularly, the doctor blade 7 is a blade spanning substantially the length of the roll 2. The blade 7 is releasably clamped or otherwise secured in a pivot bracket 17 which is suitably mounted in a support, not shown. As the gravure roll rotates, the hydraulic action of the coating fluid on the blade deflects the blade against the roll.

The doctor blade deflector 10 is fixed to the underside of the clamp bracket 17 in any suitable manner. The deflector 10 is a continuous uninterrupted member defining a continuous wall for deflecting of the material 4 across the total width of the roll 2. The cross-section of the deflector as is clearly shown in FIGS. 1 and 2 is a generally spiral-like configuration and is shown including an upper substantially straight portion 22 secured to the underside of the bracket 17. The curved portion of the deflector opens toward the opposite end of the pan and terminates in a path directed toward the predoctor assembly 9 with target lines toward the gap 15. The doctor material is turned smoothly in the upper portion of the deflector and then downwardly into the pan where it merges with the material in the pan. The doctored material 8 flows smoothly and with very minimal foaming of the material.

The level 23 of the material 4 in the pan 13 is generally at the level of the upper end of predoctor deflector 11 to the downstream side of deflector 11. The level 24 to the upstream side between deflector 11 and the doctor assembly 6 is substantially lower and the level is adjustable because of the rotation forces of the roll 2. The level will vary with roll speed and the viscosity of the material. The structure is preferably designed so that the level 24 does not fall below the lower end of the deflector 11.

The predoctor deflector 11 is shown as a semi-circular member mounted with the pan 13. The deflector 11 is affixed as a convenient mounting to the opposite end walls of the pan and thus defines a partial closure wall for confining of the material 4. The edge 5 is chamfered to define a precise angle with the tangent of the aligned portion of the roll 2, as shown 26. The angle creates a nip for the coating material to insure application of the coating to fully fill the surface of the gravure roll. The rotating roll creates hydraulic forces within the wedge-shaped nip 26 to positively force the liquid into the rolls cells. The deflector 11 is located to the downstream side of the cylinder and extends downwardly with the lower edge or the radius point 27 of the deflector 11 located slightly above the bottom of pan 14. The deflector thus extends downwardly and curves back toward the opposite side of the cylinder to define a reverse flow of the fluid, as shown at 12. The lower end of the deflector 11 is spaced upwardly from the pan bottom 13 and defines the narrow passageway 15 between its lower portion and the bottom wall. The deflector 11 extends beyond the lowest print 27 and thus curves slightly upwardly. For example, the extension may be about 10 degrees beyond the vertical plane through the center of the deflector. The gap 15 is thus generally nozzle shaped in the return flow direction of the fluid to the upstream side of the deflector 11 in the region of level 24.

The action of flow 28 and the nozzle effect is such that a pulling force is exerted on the doctor fluid 8 in the region of level 24 to forcibly pull the fluid back into the pan.

The basic level of fluid material 4 may be set in any suitable manner, and an overflow or stand pipe 30 in the leading end of the pan opposite the doctor and predoctor blade members is shown for purposes of discussion. The level is set slightly below the upper edge of the deflector 11 and the difference is generally on the thickness of the deflector. The precise relative levels will vary slightly with speed and fluid viscosity but is insignificant in comparison to the usual pan and doctor blade units used in gravure printing and the like.

The deflectors 10 and 11 are specially constructed and arranged to operate conjointly. The flow characteristic created by the two deflectors is such as to effectively balance the tendency of the rotating gravure roll to cause the material to flow and build up in the leading portion of the coating path. The interaction of the return flow creates a pressure distribution tending to establish a smooth flow characteristic. Thus, the rapid moving liquid which is forced downwardly within the predoctor deflector tends to create a venturi type action, apparently with a very significant improvement in the smooth flow of the coating material within the path and with such a manner as to maintain an essentially constant liquid level.

In summary, deflector 11 serves to limit the rotational distortion of the bath while insuring the complete filling of the roll surface with the material. In addition, the predoctor deflector 11 establishes a smooth recirculation within the main body of the fluid and establishes a smooth, non-foaming return of the doctored fluid to the pan.

The present invention thus provides a simple stablizing reliable apparatus for the ink or other fluid both for gravure applicating apparatus and the like and establishing significant improvement in the coating characteristic of the apparatus and minimizes service and downtime of the apparatus.

Various mode of carrying out the invention are contemplated as being within the scope of the following claims particularly pointing out and distinctly claiming the subject matter which is regarded as the invention.

I claim:

1. A coating apparatus including a rotating cylinder in a confined bath of coating material, comprising a fountain for containing said coating bath, a doctor blade assembly mounted adjacent said fountain and including a doctor blade adapted to operatively engage the surface of the cylinder above the level of the bath to remove excess coating material carried by the cylinder as it rotates from of the bath, the rotation of said cylinder in said bath creating forces in the bath causing the bath to flow in the direction of rotation and the doctor blade assembly, a predoctor deflector located between the lower end of the cylinder and the doctor blade assembly, said predoctor deflector being a curved plate opening opposite to the direction of said flow, said predoctor deflector having a doctoring member on the upper edge mounted in closed spaced relation to the circumference of the roll and the bottom edge of said predoctor deflector being spaced upwardly from the bottom of the fountain to define a return opening between the deflector and the bottom of the fountain, a second deflector located adjacent said doctor blade assembly, said second deflector plate being a generally curved member opening opposite to the direction of said flow, the uppermost edge of said second deflector being located adjacent the underside of said doctor blade for collecting excess material from said doctor blade assembly and extending in a curved configuration to return the doctored material to the fountain between said doctoring member and said predoctor deflector, said predoctor deflector generating a flow of material in the bath in a reverse direction to said first named flow and creating a pressure differential adjacent the lower end of said predoctor deflector to assist the flow of the doctored coating material from the doctor blade assembly and thereby providing a smooth continuous circulation of coating material operable to maintain an essentially constant level in the said bath and essentially preventing turbulence within the bath.

2. The apparatus of claim 1 wherein said predoctor deflector has a substantially semi-circular configuration, said predoctor deflector being located with the upper edge slightly spaced from the cylinder and being located with its edges in a substantially vertical plane.

3. The apparatus of claim 1 wherein said second deflector includes a first planar portion extending from one edge and merging with a substantially partial circular section, said second deflector being connected to said doctor blade assembly with said a planar portion adjacent the underside of the doctor blade to direct the flow into the curved portion, said curved portion being located to direct the flow downwardly into the space between the underside of the lower end of the predoctor deflector and the bottom wall of the fountain.

4. A coating apparatus comprising an open top container fountain for containing a liquid coating material, a rotating roll rotatably mounted with a lower portion of the roll in said bath of coating material; said roll tending to cause said material to flow within said fountain in the direction of the roll rotation, a doctor blade unit mounted adjacent said fountain and including a doctor blade adapted to operatively engage the surface of the roll above the level of the bath to remove excess coating material carried by the roll as the roll rotates from the bath and to return said material to said bath, a predoctor deflector located between the lower end of the roll and the doctor blade unit, said predoctor deflector having an upper terminal end spaced from said doctor blade and generating a flow of material directly from the predoctor deflector back within the bath and in a reverse direction from that created by said roll for circulation of coating material to minimize said movement of the material by said roll and maintain an essentially constant level in the said bath and minimize turbulence within the bath.

5. The apparatus of claim 4 wherein said predoctor deflector being a curved plate opening upstream of said flow and having a bottom edge spaced upwardly from the bottom of the fountain to define a return opening between the deflector and the bottom of the fountain, a doctor blade deflector located adjacent said docotor blade unit for collecting excess material from said doctor blade unit and extending in a curved configuration to return the doctored material to the fountain between said doctor blade unit and said predoctor deflector, and said flow created by said predoctor deflector creating a pressure differential adjacent the lower end of said predoctor deflector to assist the flow of the doctored coating material from the doctor blade unit and thereby providing a smooth continuous flow.

6. The apparatus of claim 5 wherein said doctor deflector is located and constructed to direct the doctored material downwardly into the space between the underside of the lower end of the predoctor deflector and the bottom wall of the container fountain.

7. The apparatus of claim 6 wherein said doctor deflector includes a first planar portion extending from one edge and merging with a substantially partial circular section, said doctor deflector being connected to said doctor blade unit with said a planar portion adjacent the underside of the doctor blade to direct the flow into the curved portion.

8. The apparatus of claim 4 wherein said predoctor deflector includes a predoctor means located adjacent the roll to force liquid onto the roll.

9. The apparatus of claim 4 wherein said predoctor deflector has an upper edge slightly spaced from the roll to form a small gap therebetween.

10. The apparatus of claim 9 wherein said upper edge is chamfered to define a wedge-shaped gap.

11. A coating apparatus including a rotating gravure roll in a confined bath of coating material, comprising a fountain for containing said coating bath, a doctor blade unit mounted adjacent said fountain and including a doctor blade adapted to operatively engage the surface of the cylinder above the level of the bath to doctor coating material carried from the surface of said roll, the rotation of said cylinder in said bath creating forces in the bath causing the bath to flow in the direction of rotation and the doctor blade assembly, a predoctor deflector located between the lower end of the cylinder and the doctor blade unit, said predoctor deflector being a curved plate opening upstream of said flow and having an inclined upper edge mounted in closed spaced relation to the circumference of the roll at approximately the level of the coating material to form a wedge-shaped gap for forcing material onto the gravure roll and having a bottom edge spaced upwardly from the bottom of the fountain to define a return opening between the deflector and the bottom of the fountain, a doctor blade deflector located adjacent said doctor blade unit and being a generally curved member opening opposite the direction of said flow in said bath, said doctor blade deflector located adjacent the blade for collecting said doctored material from said doctor blade and extending in a curved configuration to return the doctored material between the container and predoctor deflector, said predoctor deflector generating a flow of material in the bath in a reverse direction of said first-named flow and creating a pressure differential adjacent the lower end of said predoctor blade unit to assist the flow of the doctored coating material from the doctor blade unit and thereby providing a smooth continuous circulation of coating material operable to maintain an essentially constant level in the said bath and essentially preventing turbulence within the bath.

12. The apparatus of claim 11 wherein said doctor blade deflector includes a first portion extending from one edge and merging with a substantially partial circular section, said doctor blade deflector being connected to said doctor blade unit with said first portion adjacent the underside of the doctor blade to direct the flow into the curved portion, said curved portion being located to direct the flow downwardly into the space between the underside of the lower end of the predoctor deflector and a bottom wall of the fountain.

* * * * *

UNITED STATES PATENT AND TRADEMARK OFFICE

CERTIFICATE OF CORRECTION

PATENT NO. : 4,615,295

DATED : October 7, 1986

INVENTOR(S) : EUGENE W. WITTKOPF

It is certified that error appears in the above-identified patent and that said Letters Patent is hereby corrected as shown below:

In the Abstract, line 1, cancel "gravuer" and substitute therefor ---gravure---; Column 4, line 51, after "shown" insert ---at---; Column 6, line 61, cancel "docotor" and substitute therefor ---doctor---.

Signed and Sealed this

Twenty-sixth Day of January, 1988

*Attest:*

DONALD J. QUIGG

*Attesting Officer*

*Commissioner of Patents and Trademarks*